United States Patent [19]

Failing

[11] Patent Number: 4,763,726

[45] Date of Patent: Aug. 16, 1988

[54] HEAT EXCHANGER CORE AND HEAT EXCHANGER EMPLOYING THE SAME

[75] Inventor: Robert P. Failing, St. Joseph, Ind.

[73] Assignee: Sunstrand Heat Transfer, Inc., Dowagiac, Mich.

[21] Appl. No.: 641,474

[22] Filed: Aug. 16, 1984

[51] Int. Cl.[4] ..... F28F 13/00; F28F 1/20

[52] U.S. Cl. ..... 165/146; 165/181

[58] Field of Search ..... 165/146, 181, 184

[56] References Cited

U.S. PATENT DOCUMENTS

| | | | |
|---|---|---|---|
| 2,646,972 | 7/1953 | Schmid | 165/184 |
| 3,067,592 | 12/1962 | McFarlan | 165/146 X |
| 3,330,336 | 7/1967 | Göbel | 165/146 |
| 3,360,040 | 12/1967 | Kritzer | 165/181 |
| 3,877,517 | 4/1975 | Pasternak | 165/146 |
| 4,102,027 | 7/1978 | Greever et al. | 165/184 X |

*Primary Examiner*—Ira S. Lazarus
*Assistant Examiner*—Peggy Neils
*Attorney, Agent, or Firm*—James A. Wanner; Trevor B. Joike; Harold Williamson

[57] ABSTRACT

A heat exchanger core including a heat conducting tube. A plurality of spines are mounted on the tube in opposed groups and are separated by spine free areas, one of which faces the direction of air flow and the other of which faces away from the direction of air flow.

9 Claims, 2 Drawing Sheets

HEAT EXCHANGER CORE AND HEAT EXCHANGER EMPLOYING THE SAME

FIELD OF THE INVENTION

This invention relates to heat exchanger cores, and more specifically, to heat exchanger cores of the type utilizing tubes provided with segmented external fins.

BACKGROUND OF THE INVENTION

Prior art of possible relevance includes U.S. Pat. Nos. 2,317,519 issued Apr. 27, 1943 to Coons and 3,495,657 issued Feb. 17, 1970 to Keith.

Many heat exchangers employ cores constructed of multiple tubes which in turn are provided with segmented external fins, such fins, because of their segmentation, appearing as radially outwardly extending spines. The tubes carry a heat transfer medium subject to heating or cooling by the flow of a fluid, most typically air, across the fins and the tubes. The overall heat transfer coefficient of such structures is largely controlled by the air or fluid side heat transfer coefficient and the effective air side area over which heat transfer may occur.

When air or fluid flows across a row or rows of externally finned tubes, recirculation zones are formed on the downstream side of the tubes. These recirculation zones are areas of relatively low localized air velocity with the consequence that the air side heat transfer coefficients in such areas are relatively low and the finned heat transfer area in such zone is not utilized effectively.

Where such external fins are segmented, there is an increase in the resistance to air flow. This in turn increases the size of the recirculation zone downstream of the tube and further decreases the local air velocity both upstream and downstream of the tube which further reduces the effective heat transfer area of the finned surface. The ultimate result is poor material utilization for heat transfer on both the extreme upstream and downstream sides of the fin tube. The underutilized material used in forming the fins additionally makes the heat exchanger both larger and more costly than is necessary.

The present invention is directed to overcoming one or more of the above problems.

SUMMARY OF THE INVENTION

According to the present invention, there is provided a heat exchanger core including a tube which has segmented fins or heat transfer spines extending from the tubes in opposed groups and which are spine free on the upstream and downstream sides of the tube. As a consequence, material heretofore used in areas of low heat transfer is saved so as to greatly improve material utilization and there is provided tubes which may be more compactly arranged. Thus, the invention provides for heat exchangers of smaller size with a material cost savings.

In a preferred embodiment of the invention, the spines are integral with heat conductive tape helically wrapped about the tube.

The tube may have a generally circular cross section and the spines extend generally radially outwardly of the tube.

In a highly preferred embodiment, the spines are in arcs, each having an arc length of approximately 90° separated by spine-free areas each having an arc length of approximately 90°.

The invention contemplates that such a core will be utilized in a heat exchanger including a housing having an air inlet and an air outlet spaced therefrom to define an air flow path therebetween. A fan is provided for directing air along the flow path and means mount the tube across the flow path such that a spine-free front surface faces the inlet side of the flow path and a spine-free rear surface of the tube faces the outlet side of the flow path.

Other objects and advantages will become apparent from the following specification taken in connection with the accompanying drawings.

DESCRIPTION OF THE PREFERRED EMBODIMENT

Figure 1:
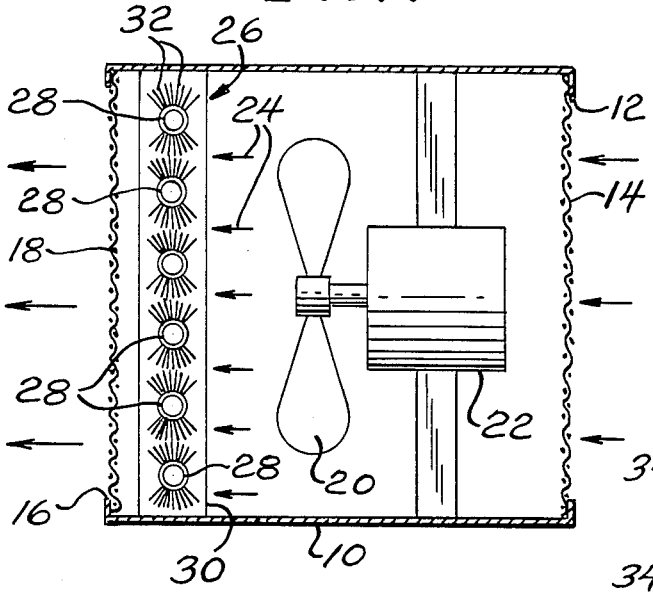
FIG. 1 is a somewhat schematic, partial sectional view of a heat exchanger embodying a core made according to the invention.

An exemplary embodiment of a heat exchanger core made according to the invention is illustrated in a typical environment in which it may be used in FIG. 1. Therein there is seen a housing 10 having an open inlet end 12 closed by wire mesh 14 and a similar outlet end 16 spaced from the inlet and also partially closed by mesh 18. The housing 10 thus defines a flow path between the inlet 12 and the outlet 16 and may contain a rotary fan 20 driven by a motor 22 for driving air in the direction of arrows 24 along the flow path.

On the outlet side of the housing 10, and downstream from the fan 20 is a heat exchanger core, generally designated 26, made according to the invention. The core 26 illustrated in FIG. 1 is a multiple tube core having plural tubes 28, formed of heat conductive material, in a single row although more than one row could be employed if desired. The tubes are adapted to carry a heat exchange medium that is to be subjected to a heat exchange operation within the heat exchanger 10 which could be either heating or cooling of the fluid contained in the tubes 28. The tubes 28 are mounted in the heat exchanger generally transverse to the flow path therein by any suitable means, such as a plate 30. Other angular configurations could be employed if desired.

Each of the tubes 28 is externally finned and carries spines 32 formed of a heat conductive material. The spines 32 on each tube 28 are in two groups and each group is separated by a spine-free area 34.

Figure 2:
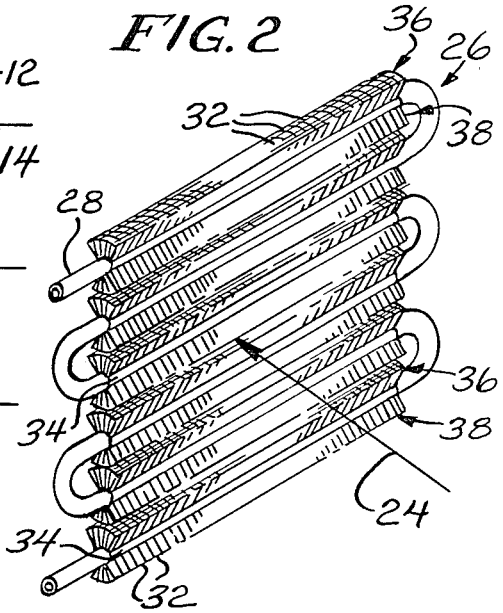
FIG. 2 is a perspective view of a multiple tube core made according to the invention.
Figure 3:
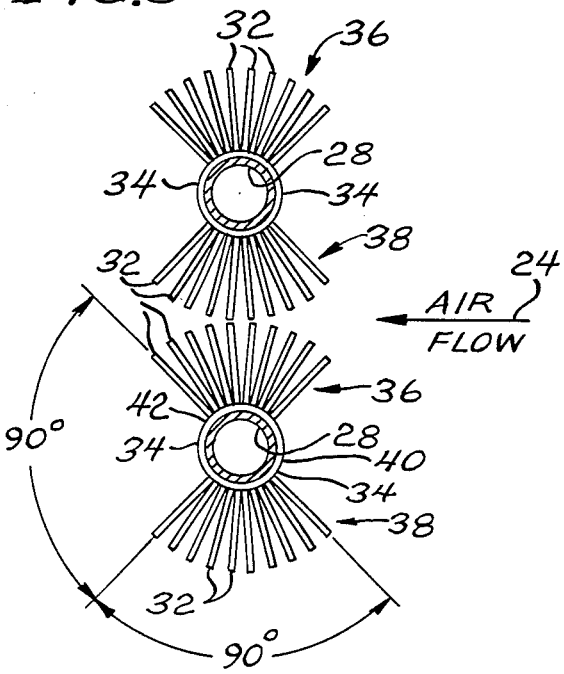
FIG. 3 is a sectional view of a core made according to the invention.

Turning now to FIG. 2, the core 26 is shown in perspective and it will be seen that the tubes 28 are defined by a single tube configured in a serpentine fashion as is well known in the art. Each run of the tube 28 carries opposed groups of the spines 32 along its length. One such group is shown generally at 36 while the other group is shown generally at 38. Each tube 28 also includes two of the spine-free areas 34 which extend along the length of the respective run of the tube 28 and which separate the groups 36 and 38 of spines. As seen in FIGS. 2 and 3, one spine-free area 34 facing the direction of air flow 24 is shown at 40 while the other spine free area of which faces away from the direction of air flow is shown at 42. Thus, one of the areas 34 on each tube faces the inlet 12 for the housing 10 as at 40 and the other faces the outlet 16 as at 42.

As can be seen in FIG. 3, where the tubes 28 have a generally circular cross section, the groups 36 and 38 have an arc length of approximately 90° while the spine-free areas 40 and 42 have a similar arc length of 90°. Where non-circular tubes are employed, the length of the groups of spines 36 and 38 will each be approximately one quadrant of the area surrounding the tube as will be each of the spine-free areas 40 and 42.

As will be seen, 90° arc lengths or quadrants are not required to achieve all of the benefits of the invention but are preferable to save in manufacturing costs.

The spines 32 may be located on the tubes 28 by any desired method. One particularly advantageous method that may be employed will be described in connection with FIGS. 4 and 5.

Figure 4:
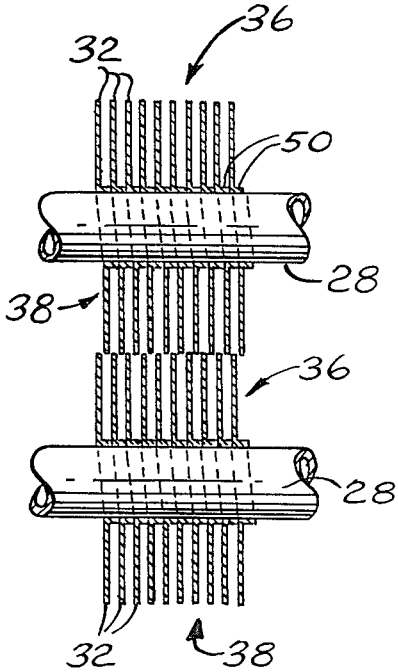
FIG. 4 is a fragmentary view along the flow path of a core made according to the invention.
Figure 5:
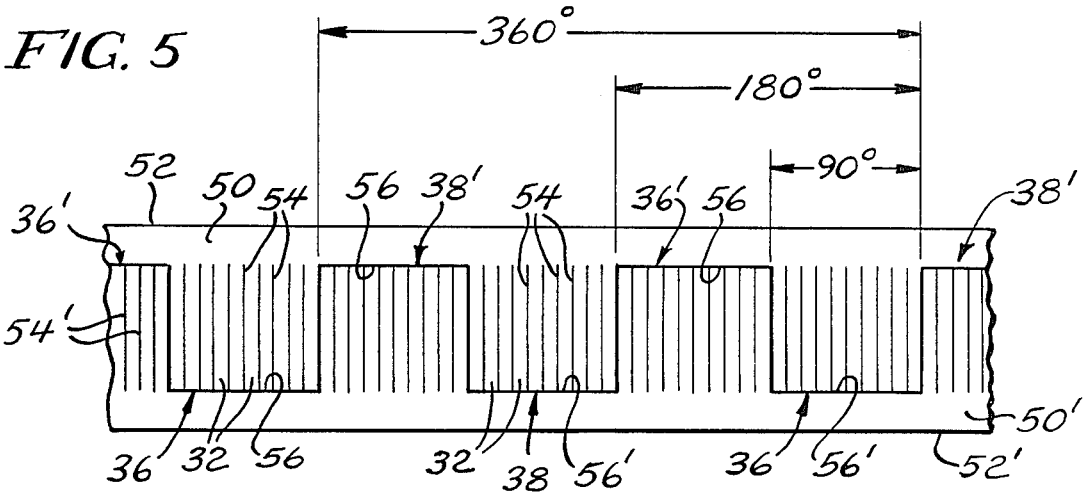
FIG. 5 is a plan view of a partially formed tape used for forming the spines utilized in the present invention.

As is well known, spine-like fins of the sort here involved are typically formed utilizing aluminum sheet or tape. One such partially formed tape is shown in FIG. 5 and is seen to include a functionally continuous portion 50 along one longitudinal edge 52 of the tape. This structure is helically wound on the tubes 28 with the functionally continuous portion 50 abutting the tube and spacing adjacent spines 32 as illustrated in FIG. 4. The spines 32 are formed by providing generally transverse slits 54 in the tape oppositely of the longitudinal edge 52. Each slit 54 defines one of the spines 32 as seen in FIG. 5.

To provide for the spine-free areas 34, the spine defining slits 54 defining the group 36 of spines 32 are separated by a relief 56 from the slits 54 defining the group 38 of spines 32. Thus, the slit areas shown in FIG. 5 and the reliefs 56 are formed in alternating fashion along the length of the tape and define the opposite longitudinal edge thereof.

As seen in FIG. 4, the spines 32 are bent at approximately right angles to the functionally continuous portion 50 such that when the tape is wound about a tube 28, the spines 32 fan out as is illustrated in FIG. 3.

As illustrated in FIG. 5, the reliefs 56 have a length corresponding to about 90° of the circumference of the tube as do each group of the slits 54 providing one of the groups 36 or 38 of the spines 32. This allows an identical tape to be formed during manufacturing such tape being given identical, but primed reference numerals in FIG. 5.

Thus, in one forming operation, two tapes may be provided. It is for this reason that the use of quadrants or arc lengths of 90° as mentioned previously is employed. If other arc lengths or segments other than quadrants were employed, only one tape could be made in a forming operation and the material cut out to form the recesses 56 or 56' would have to be discarded, although it could be reclaimed. By utilizing the configuration illustrated in FIG. 5, all material is utilized without the expense of reclaimation.

Figure 6:
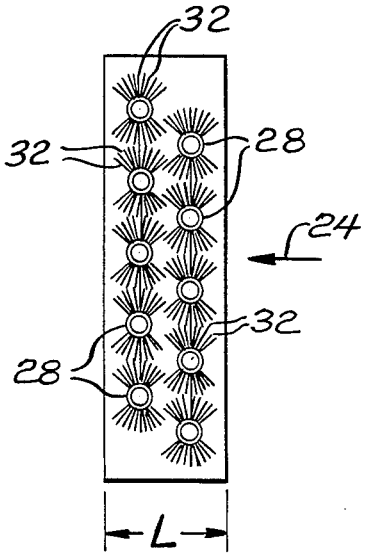
FIG. 6 is a somewhat schematic view of a multiple tube row core made according to the invention.

FIG. 6 illustrates a two row multiple tube core made according to the invention and, because the front and rear surfaces of the tubes 28 are spine-free, the rows of tubes 28 may be relatively closely spaced along the direction of air flow 24 without causing interference between the spines 32. Thus, an overall length of the core in the direction of air flow 24 is shown at L and is relatively narrow.

Figure 7:
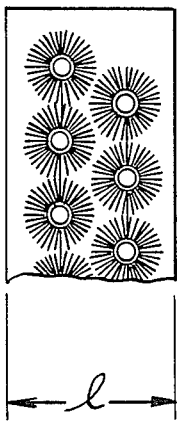
FIG. 7 (PRIOR ART)
FIG. 7 is a view similar to FIG. 6 but illustrating a prior art device.

In contrast, in a prior art construction such as is illustrated in FIG. 7, because the spines extend 360° about each of the tubes therein employed, to achieve assembly without interference between the spines, a considerably greater length "1" along the direction of air flow results.

It will therefore be appreciated that a core made according to the invention has several advantages. First, there is a reduction approaching 50% in the amount of material that must be utilized in forming the spines 32. This reduction in material is achieved with very little sacrifice of heat transfer capability since the missing material is located at the front and rear surfaces, in the direction of air flow, of each of the tubes 28 employed in the assembly. These are, of course, those where low air velocities in conventional cores prevail so that heat transfer is minimal in any event.

It can also be appreciated from a comparison of FIGS. 6 and 7 that a more compact core arrangement results; and it will likewise be appreciated that there is a reduction in length of the core along the direction of air flow even where a single row of the tubes 28 is employed. Consequently, smaller housings may be utilized providing a material savings as well as a space savings at the place of installation of the heat exchanger. Moreover, when quadrants of 90° arc lengths are employed, all material in a given tape is utilized with no wastage or need for reclaimation of scrap.

What is claimed:

1. For disposition in the air flow path of a forced air exchange system, a core comprising:

an elongated generally circular cross section conducting tube through which a fluid to be subjected to a heat exchange operation is adapted to pass, said tube adapted to be disposed in the air flow path of a forced air heat exchange system generally transversely to the direction of air flow in said path and having a front surface facing the direction of air flow, a rear surface facing away from the direction of air flow, and opposed side surfaces interconnecting said front and rear surfaces; and a heat conductive tape wrapped about said tube and having a plurality of spines of heat conductive material mounted in heat transfer relation on each of said opposed surfaces along the length thereof and extending radially outwardly from said tube to be disposed in the air flow path of the system in which said core may be used;

said front and rear surfaces being free of said spines.

2. The core of claim 1 wherein said plurality of spines associated with each of said opposed surfaces are located in an arc having an arc length of approximately 90°.

3. A heat exchanger including the core of claim 1 and further comprising a housing having an air inlet and an air outlet spaced therefrom to define an air flow path therebetween; a fan for directing air along said flow path; and means mounting said tube across said flow path with said front surfaces facing the inlet side of said flow path and said rear surface facing the outlet side of said flow path.

4. The heat exchanger of claim 3 wherein there are a plurality of said tubes with said spines disposed across said flow path in generally parallel relation.

5. For disposition in the air flow path of a forced air heat exchange system, a core comprising.

an elongated generally circular cross section heat conducting tube through which a fluid to be subjected to a heat exchange operation is adapted to pass, said tube being adapted to be disposed in the air flow path of a forced air heat exchange system generally transversely to the direction of air flow in said path and having a front surface facing the direction of air flow, a rear surface facing away from the direction of air flow, and opposed side surfaces interconnecting said front and rear side surfaces; and a heat conductive tape hexically wrapped about said tube, one longitudinal edge of said tape being provided with alternating groups of reliefs defining fin free areas and generally transverse slits portions of said tape between said groups of reliefs defining elongated fins extending outwardly from said tube, said tape being so disposed on said tube that said fins extend from both said side surfaces and said reliefs are disposed on said front and rear surfaces.

6. A heat exchanger core comprising:

an elongated tube having a generally circular cross section, made of heat conductive material and adapted to receive fluid to be subjected to a heat transfer operation; and a tape of heat conductive material helically wrapped around said tube, said tape having a functionally continuous portion contacting said tube and a longitudinal edge with said edge being defined by alternating groups of reliefs and groups of slits with said slits being at a considerable angle to the length of said tape to define spines, said spines extending away from said functionally continuous portion;

the length of said groups of reliefs and groups of slits along the length of said tape being dimensioned according to the circumference of said tube such that opposed groups of spines separated by spine free areas extend along the length of said tube.

7. The core of claim 6 wherein said groups of spines and said spin-free areas all have arc lengths of about 90°.

8. The core of claim 6 wherein said slits are generally transverse to the length of said tape.

9. The core of claim 6 wherein said functionally continuous portion is defined by another longitudinal edge of said tape.

* * * * *